US010960903B2

(12) United States Patent
Jenart et al.

(10) Patent No.: US 10,960,903 B2
(45) Date of Patent: Mar. 30, 2021

(54) RAILCAR ADAPTER FOR CONNECTING A RAILCAR BODY TO A BEARING

(71) Applicant: Aktiebolaget SKF, Gothenburg (SE)

(72) Inventors: Gautier Jenart, Saint Herblain (FR); Ludovic Fenayon, Montbazon (FR); Thierry Le Moigne, Luynes (FR)

(73) Assignee: Aktiebolaget SKF, Gothenburg (SE)

( * ) Notice: Subject to any disclaimer, the term of this patent is extended or adjusted under 35 U.S.C. 154(b) by 152 days.

(21) Appl. No.: 15/994,223

(22) Filed: May 31, 2018

(65) Prior Publication Data

US 2019/0367052 A1 Dec. 5, 2019

(51) Int. Cl.
*B61F 15/02* (2006.01)

(52) U.S. Cl.
CPC ..... *B61F 15/02* (2013.01)

(58) Field of Classification Search
CPC ..... B61F 15/00; B61F 15/02; B61F 15/04; B61F 15/06; B61F 15/12; B61F 15/20; B61F 15/26
See application file for complete search history.

(56) References Cited

U.S. PATENT DOCUMENTS

| | | | |
|---|---|---|---|
| 3,272,573 | A | 9/1966 | Payson |
| 4,687,211 | A | 8/1987 | Bessone |
| 5,237,933 | A | 8/1993 | Bucksbee |
| 5,794,538 | A | 8/1998 | Pitchford |
| 5,799,582 | A | 9/1998 | Rudibaugh |
| 7,143,700 | B2 | 12/2006 | Forbes |
| 7,775,163 | B2 | 8/2010 | Forbes |
| 7,966,946 | B1 | 6/2011 | Novak |
| 8,272,333 | B2 | 9/2012 | Forbes |
| 8,893,626 | B2 | 11/2014 | Berg |
| 9,434,393 | B2 | 9/2016 | Gotlund |
| 10,384,695 | B2 | 8/2019 | Fenayon |
| 10,399,578 | B2 | 9/2019 | Fenayon |
| 10,576,999 | B2 | 3/2020 | Fenayon |
| 10,727,718 | B2 | 7/2020 | McGoogan |
| 2014/0318412 | A1 | 10/2014 | East |
| 2015/0183442 | A1 | 7/2015 | Gotlund |
| 2017/0129510 | A1* | 5/2017 | Golembiewski ..... B61F 5/32 |
| 2017/0137040 | A1 | 5/2017 | Fenayon |
| 2017/0137041 | A1 | 5/2017 | Fenayon |
| 2017/0137042 | A1 | 5/2017 | Fenayon |
| 2019/0367052 | A1 | 12/2019 | Jenart |
| 2019/0367053 | A1 | 12/2019 | Jenart |
| 2019/0367054 | A1 | 12/2019 | Jenart |
| 2019/0367055 | A1 | 12/2019 | Jenart |
| 2019/0367056 | A1 | 12/2019 | Jenart |
| 2020/0198667 | A1 | 6/2020 | Zeitler |

* cited by examiner

*Primary Examiner* — Robert J McCarry, Jr.
(74) *Attorney, Agent, or Firm* — Garcia-Zamor Intellectual Property Law; Ruy Garcia-Zamor; Bryan Peckjian

(57) ABSTRACT

A railcar adapter for radially connecting a railcar body to a bearing, and providing an adapter body. The railcar adapter includes two channel elements having each a pair of opposed lugs and a lateral guiding surface perpendicular to the opposed lugs so as to form lateral channels adapted to cooperate with the railcar body. The lateral channel elements are mounted in transverse grooves provided to transverse surfaces of the adapter body.

26 Claims, 3 Drawing Sheets

RAILCAR ADAPTER FOR CONNECTING A RAILCAR BODY TO A BEARING

TECHNOLOGICAL FIELD

The present invention relates to the field of bearing adapters for a railcar.

BACKGROUND

A railcar generally comprises a bogie frame provided with a pair of side frames on each side having downwardly opening jaws. A bearing adapter is vertically moveable within the jaws and rests on a bearing mounted on a railcar axle carrying a wheel of the railcar. The bearing adapter is thus a rigid connection between the bogie frame of the railcar and the bearing. Typically, a bearing for a railcar axle fits around a journal at the end of the railcar axle where it is mounted between a backing ring assembly and an end cap.

However, the railcar adapter may move with respect to the bearing. The railcar adapter may be misaligned with respect to the bearing when the railcar runs over curved rail tracks. This results in unexpected wear of some parts, in particular lugs of lateral channels engaging a lug of a jaw of the bogie frame, and then reduce their service life.

The load applied by the bogie frame through the adapter may not be well distributed on the bearing, notably on the rolling elements when the bearing is of the rolling bearing type. This results in wear on the inner surface and the outer surface of the railcar adapter, as well as in failure of the bearing.

Moreover, it is desirable to provide a railcar adapter easy to manufacture and of reduced costs, and advantageously being adaptable to bogie frame of different design dimensions.

These and other problems are addressed by embodiments of the present invention.

SUMMARY

To this end, the invention relates to a railcar adapter for radially connecting a railcar body to a bearing. The railcar adapter comprises two frontal flanges that inwardly protrude with respect to the inner surface, and that delimit with the inner surface a housing for the bearing. The railcar adapter comprises an inner surface acting as a bearing seat for the bearing. The railcar adapter comprises an outer surface that is adapted to be in direct radial contact with the railcar body.

According to the invention, the railcar adapter comprises a railcar body having two lateral surfaces, at least one lateral surface being provided with a transverse groove. The railcar adapter further comprises at least one channel element provided with a pair of opposed lugs and a lateral guiding surface perpendicular to the opposed lugs so as to define a lateral channel adapted to cooperate with the railcar body, the channel element being mounted within the transverse groove of adapter body. The transverse length of transverse groove is strictly greater than the transverse length of the corresponding channel element.

Such railcar adapter with separated channel elements is easy to be mounted. The adapter body of railcar adapter may be standardized, the channel elements being adaptable depending on the application characteristics. Moreover, the channel element can slide in the transverse groove, and then compensate any relative misalignment between the railcar body and the bearing.

According to further aspects of the invention which are advantageous but not compulsory, such a railcar adapter may incorporate one or several of the following features:

The inner surface has, for example, a concave shape of constant radius so as to sit on the bearing.

The lateral guiding surfaces of channel elements, in cross-section through a plane perpendicular to the axis of rotation of bearing, are curved.

The lateral guiding surfaces of lateral channels are cylindrical.

The lateral guiding surfaces of lateral channels are spherical.

The transverse grooves comprise each a bottom surface that, in cross-section through a plane perpendicular to the axis of rotation of bearing, is curved.

The bottom surfaces are cylindrical.

The bottom surfaces are spherical.

The inner surfaces of the opposed lugs of channel elements, in cross-section through a plane perpendicular to the axis of rotation of bearing, are curved.

The inner surfaces of lugs are cylindrical.

The inner surfaces of lugs are spherical.

The adapter body is made from metal, for example, by casting. For example, the adapter body is made from cast steel or cast iron.

According to another aspect, the invention relates to a railcar adapter assembly comprising a railcar adapter according to any of the preceding embodiments, a bearing mounted inside the railcar adapter, a backing ring adapted to come into axial contact with the bearing at a first side, and an end cap assembly adapted to come into axial contact with the bearing at another side, opposite to the first side.

In one embodiment, the bearing comprises at least one inner ring and at least one outer ring mounted in radial contact with the inner surface of the railcar adapter.

In one embodiment, the bearing comprises at least one row of rolling elements, arranged between raceways provided on the inner and outer rings.

In one embodiment, the inner ring of the bearing is made in two parts, axially separated by an axial spacer.

According to another aspect, the invention relates to railcar axle comprising a railcar adapter assembly according to any of the preceding embodiments, a shaft being rotatably mounted about an axis of rotation relative to a railcar adapter, inside the bearing. The shaft comprises a first end mounted radially inside the backing ring and a second end, opposite to the first end, secured to the end cap assembly.

BRIEF DESCRIPTION OF THE DRAWINGS

Other advantages and features of the invention will emerge upon examining the detailed description of embodiments, which are in no way limiting, and the appended drawings wherein.

DETAILED DESCRIPTION

Figure 1:
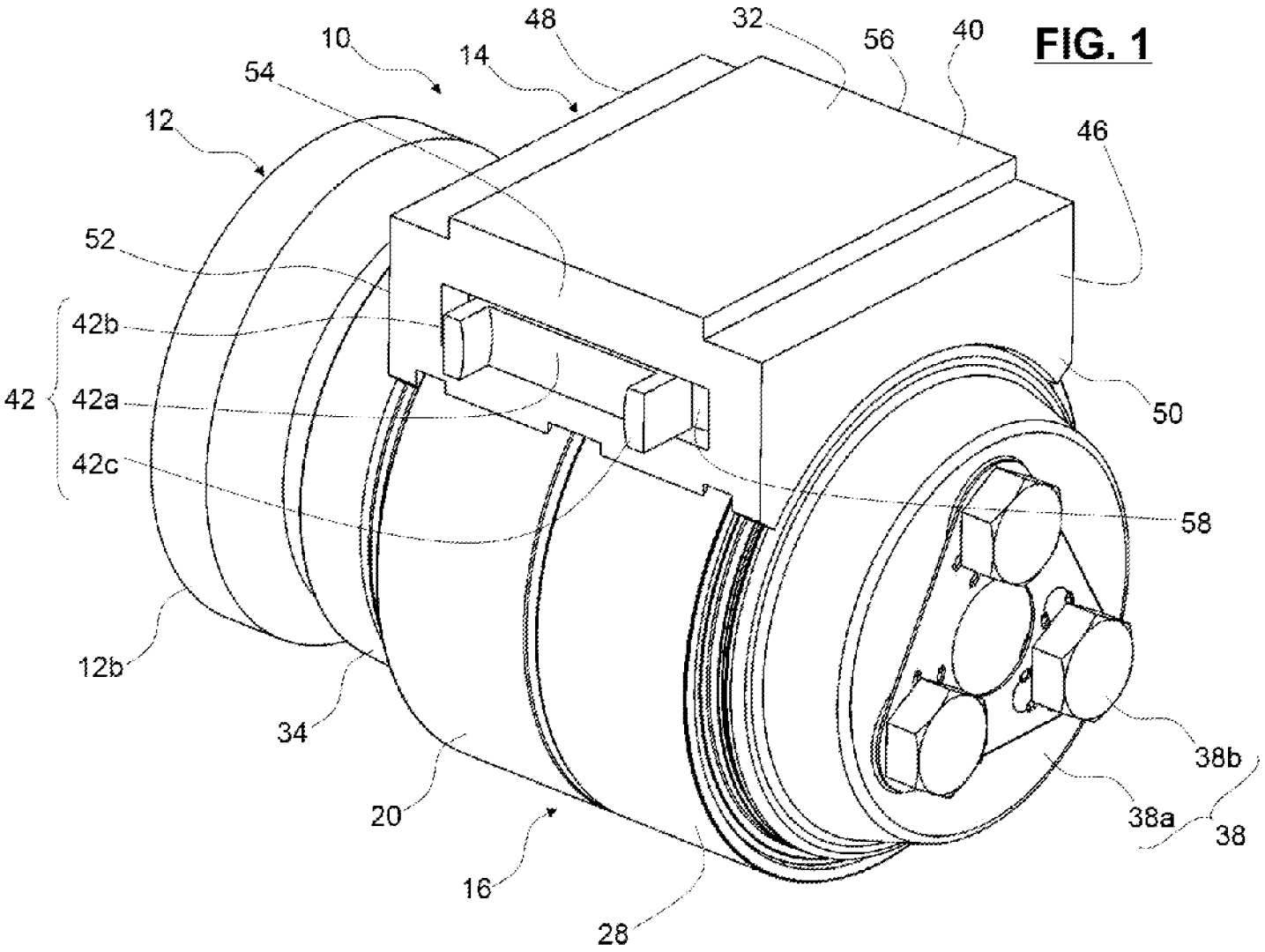
FIG. 1 is a perspective view of a railcar axle according to the invention.
Figure 2:
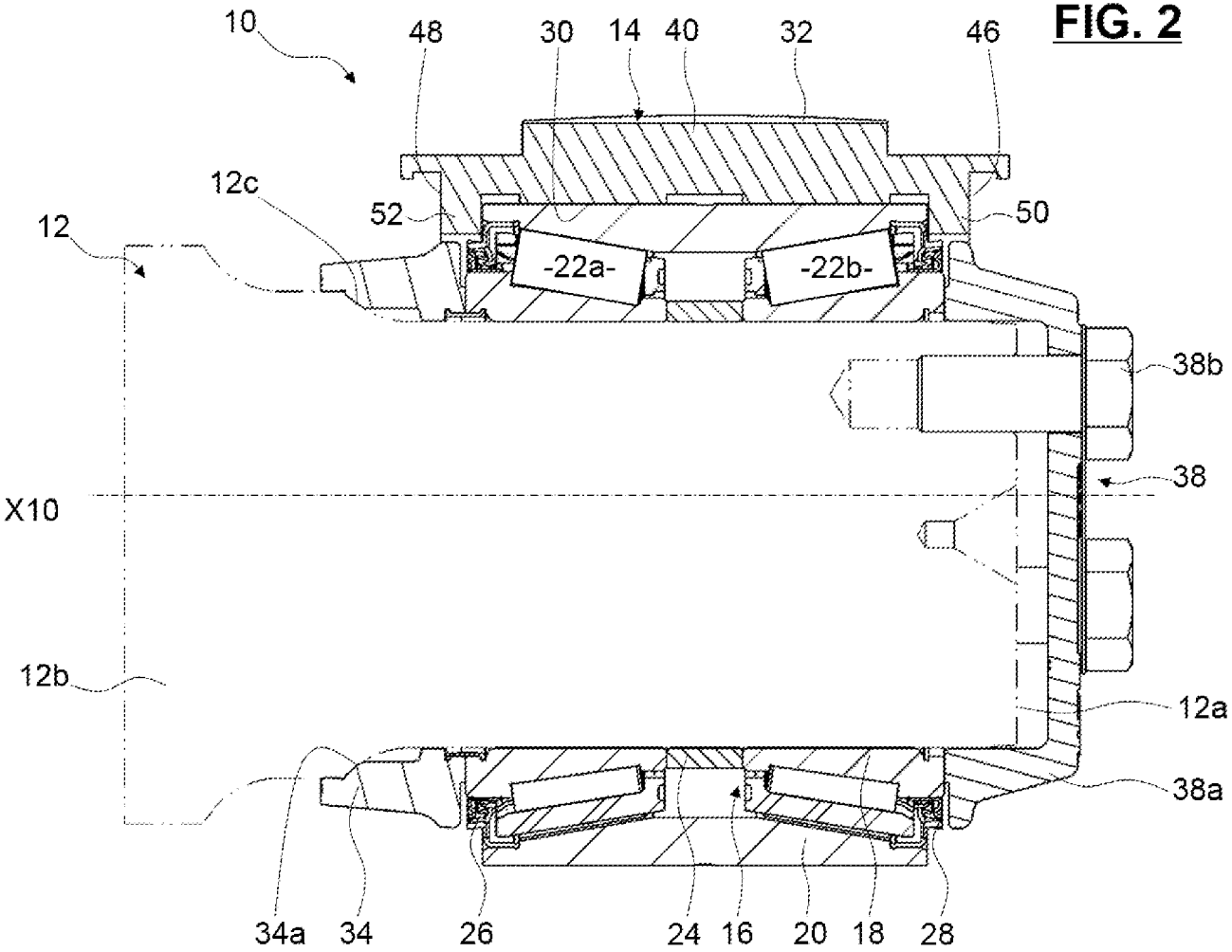
FIG. 2 is an axial cross-section of the railcar axle of FIG. 1.

Referring to FIGS. 1 and 2, a railcar axle 10 is provided for binding the bogie frame of a railcar to the wheels (not shown). The railcar axle 10 comprises a shaft 12 (in dotted lines in FIG. 2), being rotatably mounted about an axis of rotation X10 relative to a railcar adapter 14. The railcar adapter 14 is secured to the railcar bogie frame, the shaft 12 being secured to the wheels.

A bearing 16 is radially provided between the railcar adapter 14 and the shaft 12. As illustrated in FIG. 2, the bearing 16 is of the rolling bearing type, and comprises an inner ring 18 mounted on the shaft 12, an outer ring 20 mounted inside the railcar adapter 14 and two rows of rolling elements 22*a*, 22*b*, for example rollers, arranged between raceways provided on the inner and outer rings 18, 20. The inner ring 18 is, for example, made in two parts, axially separated by an axial spacer 24. In this embodiment, the bearing 16 is a tapered rollers bearing.

The bearing 16 is further provided with sealing means 26, 28 on both axial ends. Sealing means 26, 28 close a radial space defined between the inner ring 18 and the outer ring 20. The rolling elements 22*a*, 22*b* are arranged in the sealed radial space.

The railcar adapter 14 is secured to the outer ring 20 by its radially inward side or bearing seat side 30 and is mounted inside the bogie frame by its radially outward side or frame seat side 32.

The shaft 12 comprises a journal 12*a* and a dust guard having a cylindrical surface 12*b* whose diameter is bigger than the diameter of the journal 12*a*. A concave fillet 12*c* connects the cylindrical surface 12*b* on the journal 12*a*. The inner ring 18 of the bearing is mounted on the journal 12*a*.

As illustrated, the railcar axle 10 further comprises a backing ring 34 having an inner surface 34*a* adapted to radially come into contact with the outer surface of the shaft 12, at the fillet 12*c* side and to axially come into contact with the inner ring 18 of the bearing 16. Accordingly, the inner surface 34*a* of backing ring 34 has a rounded shape, almost complementary to that of the fillet 12*c*.

The railcar axle 10 also comprises an end cap assembly 38. The end cap assembly 38 includes an end cap 38*a* provided for being a stop element in case of a leftward translation (relative to FIG. 2) of the shaft 12 relative to the inner ring 18. Therefore, the end cap 38*a* is reliably secured to the journal 12 by means of three cap screws 38*b* and comes in axial contact with the inner ring 18 of the bearing 16.

Figure 3:
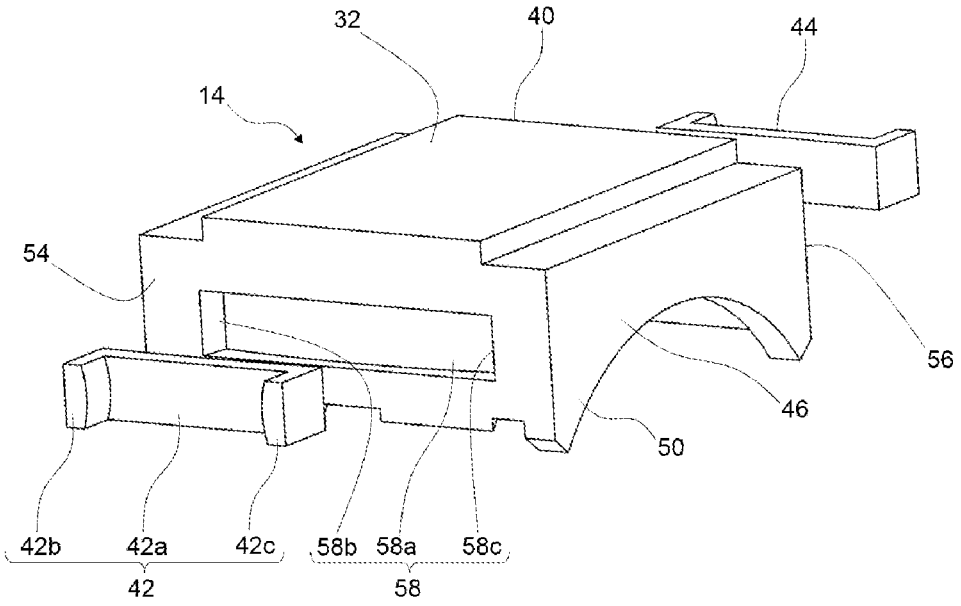
FIG. 3 is an exploded perspective view of a railcar adapter for the railcar axle of FIG. 1.

As illustrated in detail on FIG. 3, the railcar adapter 14 comprises an adapter body 40.

The body 40 of the railcar adapter 14 comprises two frontal surfaces 46, 48, two lateral surfaces 54, 56, the inner surface 30 acting as a bearing seat in radial contact with the outer ring 20 of the bearing 16, and the outer surface 32 acting as a frame seat in radial contact with the bogie frame.

The inner surface 30 has a concave shape of constant radius so as to sit on the outer cylindrical surface of the outer ring 20 of the bearing 16.

The frontal surfaces 46, 48 are provided with a first and a second frontal flanges 50, 52, respectively, directed radially inwards. The flanges 50, 52 radially inwardly protrude with respect to the inner surface 30. The flanges 50, 52 are axially opposite one each other. The flanges 50, 52 delimit with the inner surface 30 a housing for the outer ring 20 of bearing 16. The outer ring 20 is axially arranged between the flanges 50, 52.

According the invention, the two opposed lateral surfaces 54, 56 are each provided with a transverse groove 58. Only the transverse groove 58 of lateral surface 54 will be further described, the transverse groove of the opposed lateral surface 56 being identical. The transverse groove 58 extends transversally between the opposed frontal surfaces 46, 48. The transverse groove 58 is delimited by a pair of opposed side walls 58*b*, 58*c* and a bottom surface 58*a* perpendicular to the walls.

The railcar adapter 14 is provided with a pair of channel elements 42, 44 mounted to the adapter body 40. The first channel element 42 is mounted in the transverse groove 58 provided to the lateral surface 54 of adapter body 40. The second channel element 44 is mounted in the transverse groove provided to the opposed lateral surface 56 of adapter body 40. Only the first channel element 42 will be further described, the second channel element 44 being identical.

The first channel element 42 is axially delimited by a pair of opposed lugs 42*b*, 42*c* and a lateral guiding surface 42*a* perpendicular to the lugs. The channel element 42 forms a lateral channel having a U-shape and being adapted to engage with a lug of a jaw (not shown) of the bogie frame, so as to act as an insertion guide between the adapter and the bogie frame.

Advantageously, the transverse length of transverse groove 58 is strictly greater than the transverse length of the corresponding channel element 42. The channel element 42 is then able to slide in the transverse groove 58, in particular in case of relative misalignment between the bogie frame and the adapter. The position of channel element 42 in the adapter body 40 moves with respect to the relative position between the bogie frame and the bearing 16.

Advantageously, the bottom surfaces 58*a* of transverse grooves 58 are curved, in cross-section through a perpendicular plane to the axis of rotation X10 of the bearing 16. In the illustrated embodiment, the lateral guiding surfaces 42*a* of channel elements 42, 44 are flat. The bottom surfaces 58*a* are cylindrical. Alternatively, the bottom surfaces may be spherical.

The bogie frame comprises lugs of jaws engaged within the lateral channels 42 of railcar adapter 14, and in abutment against the flat lateral guiding surfaces 42*a*. In case of relative misalignment between the bogie frame and the bearing 16, the channel elements 42, 44 can slide in the corresponding grooves 58, and swivel onto the curved bottom surfaces 58*a* of the grooves 58. The misalignment is then compensated. The adapter body 40 is prevented from any displacement with respect to the bearing 16. The load applied by the bogie frame through the adapter is uniformly distributed on the bearing, notably on the rolling elements when the bearing is of the rolling bearing type. Such arrangement improves the service life of the railcar adapter and the bearing by reducing wear.

As an alternate (not illustrated), the bottom surfaces 58*a* of grooves 58 are flat, and the lateral guiding surfaces 42*a* of channel elements 42, 44 are curved.

Advantageously, the inner surfaces of the opposed lugs 42*b*, 42*c* of channel elements 42, in cross-section through a plane perpendicular to the axis of rotation X10 of bearing 16, are curved and form swiveling means. For example, the surfaces may be cylindrical or spherical.

The adapter body 40 is made from metal by any suitable process, such as, for example, by casting. For example, the body 40 is made from steel or cast iron.

The channel elements 42, 44 are made from metal by any suitable process, such as, for example, by casting. For example, the elements 42, 44 are made from steel or cast iron. Alternatively, the elements 42, 44 is made from plastic or polymeric material.

It should be noted that the embodiments, illustrated and described were given merely by way of non-limiting indicative examples and that modifications, combinations and variations are possible within the scope of the invention.

The invention has been illustrated on the basis of a rolling bearing provided with at least one row of rolling elements radially disposed between the inner and outer rings. Alternatively, the bearing may be a plain bearing or a sliding bearing comprising one or two rings.

What is claimed is:

1. A railcar adapter for radially connecting a railcar body to a bearing, and comprising:

an inner surface acting as a bearing seat for the bearing which has an axis of rotation, an outer surface that is adapted to be in direct radial contact with the railcar body, wherein the railcar adapter comprises a railcar body having two lateral surfaces, at least one lateral surface being provided with a transverse groove, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, and wherein the transverse length of transverse groove is strictly greater than the transverse length of the corresponding channel element wherein the lateral guiding surface of each of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface.

2. The railcar adapter according to the claim 1, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved.

3. The railcar adapter according to the claim 1, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs.

4. A railcar adapter for radially connecting a railcar body to a bearing, and comprising:

two frontal flanges that inwardly protrude with respect to the inner surface, and that delimit with the inner surface a housing for the bearing which has an axis of rotation, an inner surface acting as a bearing seat for the bearing, an outer surface that is adapted to be in direct radial contact with the railcar body, wherein the railcar adapter comprises a railcar body having two lateral surfaces, at least one lateral surface being provided with a transverse groove, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, wherein the lateral guiding surface of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface, and wherein the transverse length of transverse groove is strictly greater than the transverse length of the corresponding channel element.

5. The railcar adapter according to claim 4, wherein the lateral guiding surfaces are cylindrical.

6. The railcar adapter according to the claim 5, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs.

7. The railcar adapter according to claim 4, wherein the lateral guiding surfaces are spherical.

8. The railcar adapter according to the claim 4, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved.

9. A railcar adapter for radially connecting a railcar body to a bearing, and comprising:

two frontal flanges that inwardly protrude with respect to the inner surface, and that delimit with the inner surface a housing for the bearing, an inner surface acting as a bearing seat for the bearing which has an axis of rotation, an outer surface that is adapted to be in direct radial contact with the railcar body, wherein the railcar adapter comprises a railcar body having two lateral surfaces, at least one lateral surface being provided with a transverse groove, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, and wherein the transverse length of transverse groove is strictly greater than the transverse length of the corresponding channel element.

10. The railcar adapter according to claim 9, wherein the bottom surfaces are cylindrical.

11. The railcar adapter according to the claim 10, wherein the lateral guiding surface of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface.

12. The railcar adapter according to claim 9, wherein the bottom surfaces are spherical.

13. The railcar adapter according to the claim 9, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs.

14. A railcar adapter for radially connecting a railcar body to a bearing, and comprising:

two frontal flanges that inwardly protrude with respect to the inner surface, and that delimit with the inner surface a housing for the bearing which has an axis of rotation, an inner surface acting as a bearing seat for the bearing, an outer surface that is adapted to be in direct radial contact with the railcar body, wherein the railcar adapter comprises a railcar body having two lateral surfaces, at least one lateral surface being provided with a transverse groove, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs, and wherein the transverse length of transverse groove is strictly greater than the transverse length of the corresponding channel element.

15. The railcar adapter according to claim 14, wherein the inner surfaces of lugs are cylindrical.

16. The railcar adapter according to the claim 15, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved.

17. The railcar adapter according to claim 14, wherein the inner surfaces of lugs are spherical.

18. The railcar adapter according to the claim 14, wherein the lateral guiding surface of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface.

19. A railcar adapter for radially connecting a railcar body to a bearing, and comprising:

two frontal flanges that inwardly protrude with respect to the inner surface, and that delimit with the inner surface a housing for the bearing, an inner surface acting as a bearing seat for the bearing which has an axis of rotation, an outer surface that is adapted to be in direct radial contact with the railcar body, wherein the railcar adapter comprises a railcar body having two lateral surfaces, at least one lateral surface being provided with a transverse groove, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, wherein the lateral guiding surface of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs, and wherein the transverse length of transverse groove is strictly greater than the transverse length of the corresponding channel element.

20. A railcar adapter assembly having a railcar adapter, a bearing mounted inside the railcar adapter, a backing ring adapted to come into axial contact with the bearing at a first side, and an end cap assembly adapted to come into axial contact with the bearing at another side, opposite to the first side, the railcar adapter for radially connecting a railcar body to a bearing, and comprising:

two frontal flanges that inwardly protrude with respect to the inner surface, and that delimit with the inner surface a housing for the bearing, an inner surface acting as a bearing seat for the bearing which has an axis of rotation, an outer surface that is adapted to be in direct radial contact with the railcar body, wherein the railcar adapter comprises a railcar body having two lateral surfaces, at least one lateral surface being provided with a transverse groove, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, and wherein the transverse length of transverse groove is strictly greater than the transverse length of the corresponding channel element wherein the lateral guiding surface of each of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface.

21. The railcar adapter assembly according to the claim 20, wherein the transverse grooves each form a slot through one of the two lateral surfaces to define a bottom slot surface that extends between inner and outer surfaces of the railcar adapter, the bottom slot surface, when viewed in cross-section through a plane perpendicular to the axis of rotation, is curved.

22. The railcar adapter assembly according to the claim 20, wherein the inner surfaces of the opposed lugs of channel elements, when viewed in cross-section through a plane which is planar parallel to the axis of rotation of the bearing, each define a continuous convex curve extending away relative to a perimeter of the transverse groove toward a center thereof, the continuous convex curve extending between opposing edges of the inner surface, the continuous convex curve being present along an entire width of each of the opposed lugs.

23. The railcar adapter assembly according to the claim 20, wherein the bearing comprises at least one inner ring and at least one outer ring mounted in radial contact with the inner surface of the railcar adapter.

24. The railcar adapter assembly according to the claim 20, wherein the bearing comprises at least one row of rolling elements, arranged between raceways provided on the inner and outer rings.

25. The railcar adapter assembly according to the claim 20, wherein the inner ring of the bearing is made in two parts, axially separated by an axial spacer.

26. A railcar axle having a railcar adapter assembly including a bearing mounted inside the railcar adapter, a backing ring adapted to come into axial contact with the bearing at a first side, and an end cap assembly adapted to come into axial contact with the bearing at another side, opposite to the first side, a shaft being rotatably mounted about an axis of rotation relative to a railcar adapter, inside the bearing, the shaft comprising a first end mounted radially inside the backing ring and a second end, opposite to the first end, secured to the end cap assembly, the railcar adapter for radially connecting a railcar body to a bearing, and comprising:

two frontal flanges that inwardly protrude with respect to the inner surface, and that delimit with the inner surface a housing for the bearing, an inner surface acting as a bearing seat for the bearing which has an axis of rotation, an outer surface that is adapted to be in direct radial contact with the railcar body, wherein the railcar adapter comprises a railcar body having two lateral surfaces, at least one lateral surface being provided with a transverse groove, wherein the railcar adapter further comprises at least one channel element having a pair of opposed lugs and having a lateral guiding surface extending therebetween and configured to face outwardly from the railcar body, the opposed lugs and the lateral guiding surface defining a lateral channel which extends longitudinally along the direction of the transverse groove and is adapted to cooperate with the railcar body, the channel element being mounted within the transverse groove of adapter body, and wherein the transverse length of transverse groove is strictly greater than the transverse length of the corresponding channel element wherein the lateral guiding surface of each of the at least one channel element, when viewed in cross-section through a plane perpendicular to the axis of rotation, defines an outwardly facing continuous convex curve which extends between opposing edges of the lateral guiding surface, the outwardly facing continuous convex curve being present along an entire length of the lateral guiding surface.

* * * * *